US009538268B2

(12) United States Patent
Gladwin et al.

(10) Patent No.: US 9,538,268 B2
(45) Date of Patent: Jan. 3, 2017

(54) COMPLEMENTARY ASYMMETRIC TRANSDUCER CONFIGURATION FOR LOWER DISTORTION AND EXTENDED RANGE

(71) Applicants: Timothy A. Gladwin, Pakenham (CA); Jason B. Cochrane, Arnprior (CA); David Logan, Pakenham (CA)

(72) Inventors: Timothy A. Gladwin, Pakenham (CA); Jason B. Cochrane, Arnprior (CA); David Logan, Pakenham (CA)

(73) Assignee: DEFINITIVE TECHNOLOGY, LLC, Owings Mills, MD (US)

( * ) Notice: Subject to any disclaimer, the term of this patent is extended or adjusted under 35 U.S.C. 154(b) by 224 days.

(21) Appl. No.: 14/286,778

(22) Filed: May 23, 2014

(65) Prior Publication Data

US 2015/0341710 A1 Nov. 26, 2015

Related U.S. Application Data

(60) Provisional application No. 61/826,909, filed on May 23, 2013.

(51) Int. Cl.

| | |
|---|---|
| ***H04R 1/00*** | (2006.01) |
| ***H04R 1/24*** | (2006.01) |
| ***H04R 1/26*** | (2006.01) |
| ***H04R 9/06*** | (2006.01) |

(52) U.S. Cl.
CPC *H04R 1/00* (2013.01); *H04R 1/24* (2013.01); *H04R 1/26* (2013.01); *H04R 9/063* (2013.01)

(58) Field of Classification Search
CPC ..... H04R 1/24; H04R 1/26; H04R 9/063; H04R 1/025; H04R 1/20
See application file for complete search history.

(56) References Cited

U.S. PATENT DOCUMENTS 4,565,905 A * 1/1986 Nation ..... H04R 1/24 381/182

* cited by examiner

*Primary Examiner* — Matthew Eason
(74) *Attorney, Agent, or Firm* — J. Andrew McKinney, Jr.; McKinney & Associates, LLC.

(57) ABSTRACT

An improved loudspeaker system includes an asymmetrical array of dissimilar drivers, namely a first driver and a second complementary driver configured in an array and driven in parallel so that the measured on-axis frequency response and the output power (SPL) is improved as compared to a symmetrical array (with similar or matched midrange or mid-bass drivers), while retaining a flat tonal balance. This speaker system and method for voicing was discovered to provide lower distortion, improved frequency response and greater clarity as compared to the prior art or traditional (e.g., MTM) loudspeaker configurations.

20 Claims, 11 Drawing Sheets

Complementary pair of asymmetrical midrange transducers

Preferred embodiment of Asymmetrical suspensions

Geometric arrangement for a three-driver, two-way loudspeaker with no lobing error.

Illustrates that the synergy of complementary dissimilar drivers improves dynamic range.

Preferred embodiment of Asymmetrical suspensions

Suspension asymmetries of forward suspension vs reverse suspension

Suspension asymmetries of forward suspension vs reverse suspension

One each of 2 different, but complimentary drivers are combined in an enclosure to act as one driver (soid curve). Drivers that are quite dissimilar or not complementary will have 2 impedance peaks.

$$excursion = 1.211 \times W$$

$$SD = \pi R^2$$

$$efficiency = 1.18 \times \frac{(SD)^2}{(2\pi \times 345 \times Re)} \times \left(\frac{(BL)}{(MMS)}\right)^2$$

$$SPL = 10Log_{10} \times \left(\frac{(efficiency)}{(0.0000000000002\pi)}\right)$$

COMPLEMENTARY ASYMMETRIC TRANSDUCER CONFIGURATION FOR LOWER DISTORTION AND EXTENDED RANGE

PRIORITY CLAIM AND REFERENCE TO RELATED APPLICATIONS

This application claims the benefit of U.S. Provisional Patent Application No. 61/826,909, of Timothy A. Gladwin et al, filed May 23, 2013 and entitled "Complementary Asymmetric Transducer Configuration for lower distortion and extended range", the disclosure of which is hereby incorporated herein in its entirety by reference. This application is directed to improvements in Loudspeaker systems and components such as those described in commonly-owned U.S. Pat. Nos. 5,887,068, and 7,684,582, the disclosures of which are hereby incorporated herein in their entireties by this reference.

BACKGROUND OF THE INVENTION

Field of the Invention

The present invention relates, in general, to loudspeaker driver design and transducer apparatus and methods for improving the perceived listening performance and clarity of high-fidelity loudspeakers.

Discussion of Related Art

Prior art loudspeakers range from products that are relatively accurate reproducers of a sound field to lesser designs which provide marginal clarity and intelligibility. Loudspeaker design has evolved into a nuanced art, where designers evaluate sources of distortion generated within loudspeaker drivers as well as sources of distortion generated among or between drivers and other components in multi-way loudspeaker systems, like the 3-driver 2-way configuration now known as the D'Appolito "MTM" array, which was shown to reduce polar response asymmetries (see J. A. D'Appolito, Paper Number: 2000(F-2), AES Conference: 74th Convention (October 1983)) and has gained widespread acceptance in the high-fidelity loudspeaker marketplace.

Multi driver loudspeaker system designs have measurable practical performance limitations and there will always be a desire for greater fidelity or accuracy, louder playback levels (at specified distortion level maximums), lower distortion (at any playback level) and greater frequency response (at specified playback levels and distortion level maximums). Typical observations made by a layperson when first encountering high quality audio reproduction are that the sound is "clean" (meaning undistorted and accurately reproduced in rich detail) and "loud" (meaning that the sound pressure level of the playback approaches the sound pressure level ("SPL") of the reproduced performance or event).

Loudspeaker systems typically have one set or array of transducers or drivers facing forward to provide the direct sound, and may optionally include a second identical set of transducers facing rearward (e.g., for Bipolar sound fields, where the rearward array is driven in phase to enhance the reflected sound field). The sound field consists of sound from the transducers which must be balanced to provide playback meeting the clarity requirements and reduced sound colorization is desirable.

Loudspeaker designers may evaluate performance of a design objectively by measuring acoustic performance and typically, loudspeakers are "voiced" either by ear, by measurements, or a combination of the two methods. The most common, and generally considered the most important, measurement is the on-axis free-field (anechoic) Sound Pressure Level (SPL) vs. frequency response which is measured with one or more microphones. Since humans do not listen as a microphone, humans interpret the complex sound field from a speaker and are sensitive to anomalies that produce distortions in the perceived sound.

Currently available high quality electro-acoustic cone diaphragm transducers, such as may be used in the loudspeaker systems described above, can create additional problems, depending on how they are configured (e.g., high frequency distortions caused by destructive interference within the transducer) and so the distortions and dynamic compression problems generated within each transducer must also be considered.

In conventional loudspeakers, efficiency requires a diaphragm which is both strong and light weight. Strength and light weight is typically achieved using a truncated cone shaped diaphragm with the minor diameter of the cone inside the transducer and the major diameter (flare or mouth) of the cone pointed out towards the front of the transducer. The cone shaped diaphragm may have straight or curved sides. The depth of the cone is such that at high frequencies the center of the cone may be ½ wavelength of sound deeper than the cone periphery, thereby causing the destructive interference described above. The destructive interference is frequency dependent, resulting in uneven frequency response, reduced efficiency, and audible distortion of the sound.

FIGS. 1B and 1C illustrate in an electrodynamic acoustic transducer 300 as previously disclosed and described in commonly owned U.S. patent application Ser. No. 13/162,296, the entire disclosure of which is incorporated by reference. That transducer or driver has a cone-shaped or frustoconical diaphragm attached at the periphery of its center opening to a voice coil, so that movement of the voice coil translates into axial reciprocating movement of the diaphragm. The voice coil is disposed on and is capable of moving along a cylindrical pole piece.

In the illustrated driver of FIGS. 1B and 1C, an annular spider 340 is attached at its outer periphery to an annular, planar spider support plateau 346 defined in frame 345. The inner periphery of the spider 340 is attached to the upper end of the bobbin or former carrying voice coil 315, below the diaphragm 310. In this way, the spider 340 provides elastic support for the voice coil 315, aligning and centering the voice coil 315 on the pole piece 320 in both radial and axial directions. Referring again to FIG. 1B, illustrating an upward facing driver 300, when at rest, spider 340 is substantially symmetrical or level, meaning that spider 340 is defined substantially within a single "at rest spider" plane which is substantially parallel with the planar surface of planar front plate 335, where the spider's inner peripheral attachment to the voice coil bobbin 315 and outer peripheral attachment to the frame 345 lie within that level spider plane. This level, symmetrical support for spider 340 is configured to provide a substantially equal elastic resistance to diaphragm excursion in either the push or pull excursion direction.

The spider 340 may be made from flexible material that can hold the voice coil 315 in place when the voice coil 315 is not driven by an electric current, and also allow the voice coil 315 to move up and down axially and (according to the models and specifications) symmetrically under influence of the electromotive push or pull force when the voice coil 315 is driven by an alternating electric current. Symmetrical response might be more properly characterized as the "ideal" or predicted response. The applicants have observed that actual loudspeaker suspension components don't exhibit this ideal symmetrical response, however. There are other loudspeaker components which are part of the suspension system for the driver's diaphragm, and those suspension components also fail to exhibit this ideal symmetrical response.

Applicants have discovered that when these prior art driver structures are combined into multi-driver systems, the resulting systems do not provide all that could be hoped for in the areas of low distortion and wide dynamic range. In order to obtain better performance in a cost effective way, there is a need for a loudspeaker configuration and method which overcomes the problems with the prior art and provides a cost effective improvement in sound quality for listeners using loudspeaker systems for sound projection or reproduction.

SUMMARY OF THE INVENTION

It is, therefore, an object of the present invention to overcome the problems with the prior art and provide an enhanced loudspeaker system and method for configuring a multi-driver loudspeaker system.

The applicants have discovered that certain loudspeaker components can be configured to make surprisingly synergistic use of properties which can be advantageously exploited a novel selection and assembly method to make complementary loudspeaker drivers with dissimilar characteristics, for use in cost effective, high performance loudspeaker arrays.

As noted above, loudspeaker drivers often have a frustoconical diaphragm connected to a surrounding frame by a two-part suspension system including an edge roll suspension which extends around the diaphragm's edge and within the frame. The roll suspension connects the outer, forward edge of the diaphragm to the inner edge of the frame or basket and flexes as the diaphragm is displaced linearly and axially relative to the frame. The second part of the two-part suspension system is a substantially planar, pleated annular spider which connects to the diaphragm's outer surface or to a voice coil assembly used to drive the diaphragm's proximal rearward end and connects to a spider support surface within the frame. The spider suspension member connects the rear or proximal end of the diaphragm to a support surface in or on the frame or basket and also flexes as the diaphragm is displaced linearly and axially relative to the frame. So the edge roll and spider work together to support and align the diaphragm during axial excursions, in and out. Spiders are spring-like and so are typically considered to have a linear relationship with force applied vs distance moved (N/mm) for any excursion from 0 mm to Xmax (the excursion limit). The force vs distance should be the same for inward and outward excursions. This ideal spider may be considered "linear and symmetrical".

Applicants have observed that real spider components do not behave this way and so are not ideal, and the force vs distance changes at the ends of the excursion (gets stiffer and eventually stops or rips). The gradual stiffening should be the same for inward and outward excursion, and if so, the spider might be fairly characterized as "nonlinear but symmetrical". In reality, it is difficult to get the spider to have perfectly symmetrical characteristics in regard to the force vs distance. Thus one sees spiders that have a different force vs distance characteristic for the inward excursion than the outward excursion. This spider is therefore nonlinear and asymmetrical. Asymmetry in the force vs distance relationship of a driver is directly related to the amount of distortion produced.

One way to compensate for the excursion resistance differences in asymmetrical spiders is to use two spiders, stacked (one upside down) together and the sum of the combined force vs distance thus becomes more symmetrical. This is what the patent is about, although the complementary asymmetrical (opposing) spiders are each in their own respective loudspeaker driver, where the complementary drivers are driven in parallel, or by identical drive signals. Put another way, in one of the two drivers, one of the spiders is upside down or reversed, so that when examining complementary asymmetric drivers with pleated spiders, one spider will have the outer ripple being a valley, and the other driver's spider has its outer ripple is a peak. Edge surrounds also exhibit asymmetrical responses to excursions in the two directions, so in the complementary drive units of the present invention, one driver's edge surround is forward (arch up) and the other driver's edge surround is reversed (arch inverted).

In the complementary asymmetric transducer configuration and loudspeaker system of the present invention, overall distortion is much less than in systems using a traditional combination of symmetric drivers (e.g., 10). This is achieved by combining drivers with characteristics that are asymmetric such that the characteristics complement each other in synergy. In one embodiment, a midrange may have particularly good low frequency distortion, but the high frequency range may be limited by distortion. It is desirable to increase the high frequency range without increasing distortion. A second driver is designed such that it has extremely low distortion at high frequencies at the expense of low frequency distortion. While the distortion mechanisms of an electro-magnetic transducer may be determined, practical design constraints force compromises. If the aforementioned 2nd driver's distortion mechanisms are such that they are exactly asymmetric to the first driver, and if the parameters of the two drivers are otherwise similar, then the current invention teaches that the drivers can be combined in such a way that the SPL benefits to the fullest, while the distortion in any particular frequency range is at least partially cancelled by the asymmetry.

One way that asymmetry is achieved is by finding the components of the transducers that are inherently asymmetric and reversing them on the complementary transducer. The surround or edge typically is an arch shaped piece of elastomer that contributes greatly to the asymmetry of the transducer suspension. There are constraints on the design of the surround that cause it to be non-linear and asymmetric. By combining a first transducer with a forward facing surround with a second transducer with a reversed surround, the performance asymmetries will partially cancel each other out, resulting in the system behaving more linear response and lower distortion than a system with pair of identical matched transducers.

The foregoing and additional objects, features and advantages of the invention will become apparent to those of skill in the art from the following detailed description of preferred embodiments, as illustrated in the accompanying drawings in which reference numerals provided in the various views and the description refer to the same apparatus elements and method steps.

DETAILED DESCRIPTION OF PREFERRED EMBODIMENTS

Figure 1A:
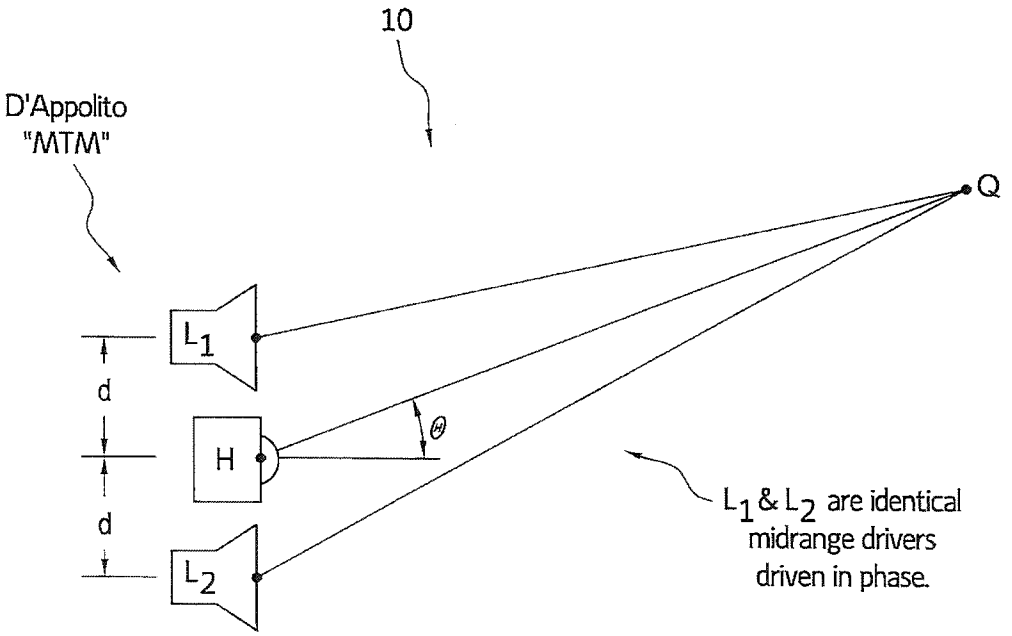
FIG. 1A Prior Art
FIG. 1A is a diagram illustrating traditional D'Appolito Midrange-Tweeter-Midrange "MTM" array having identical midrange drivers L1 and L2, in accordance with the prior art.

Reference will now be made in detail to the embodiments of the invention that are illustrated in the accompanying drawings, FIGS. 2-6. Same or similar reference numerals may be used in the drawings and the description to refer to the same apparatus elements and method steps. The drawings are in simplified form, not to scale, and omit apparatus elements and method steps that can be added to the described systems and methods, while including certain optional elements and steps. For purposes of convenience and clarity only, directional terms such as top, bottom, left, right, up, down, over, above, below, beneath, upper, lower, rear, and front may be used with respect to the accompanying drawings. These and similar directional terms should not be construed to limit the scope of the invention. Thus, as used herein, "front", "front-facing" and "forward" should be construed to mean a direction which substantially opposes "back, "rear-facing" or "rearward."

Referring initially to Prior Art FIG. 1A, the traditional D'Appolito Midrange-Tweeter-Midrange "MTM" array has a central tweeter "H" centered between "identical midrange drivers L1 and L2." This traditional D'Appolito "MTM" array 10 has often been used and it remains a cardinal rule, for speaker designers, to choose the midrange drivers carefully and find substantially "identical" midrange drivers L1 and L2. Matched midrange drivers were seen as the optimum design choice. The present invention (as described and illustrated below) discards this "identical driver" cardinal rule, because the applicants have found something which provides better performance.

Figure 2:
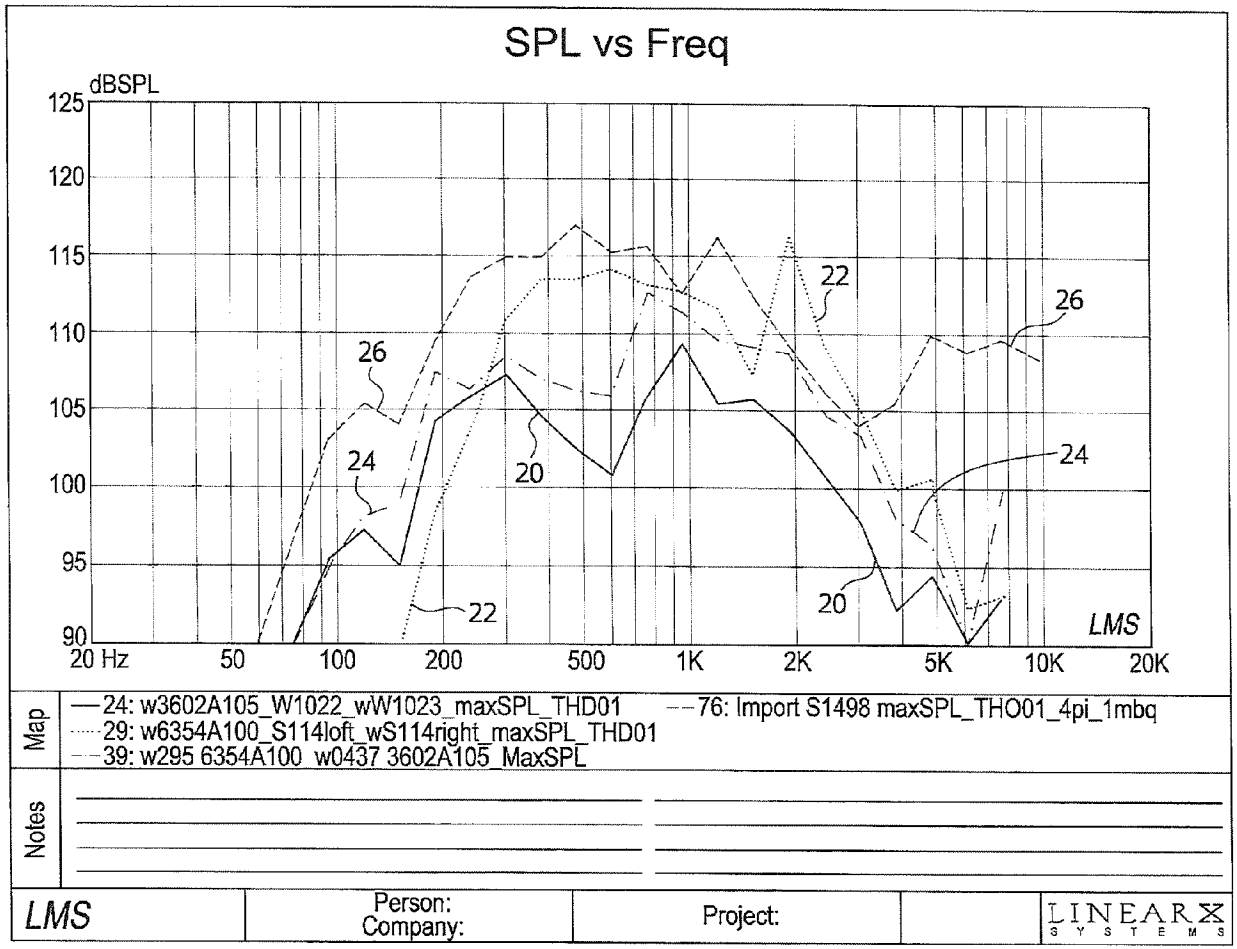
FIG. 2 is a plot of SPL v. Frequency at a selected distortion limit for Four loudspeaker system configurations, illustrating the synergy of complementary dissimilar asymmetric drivers, in accordance with the present invention.
Figure 3A:
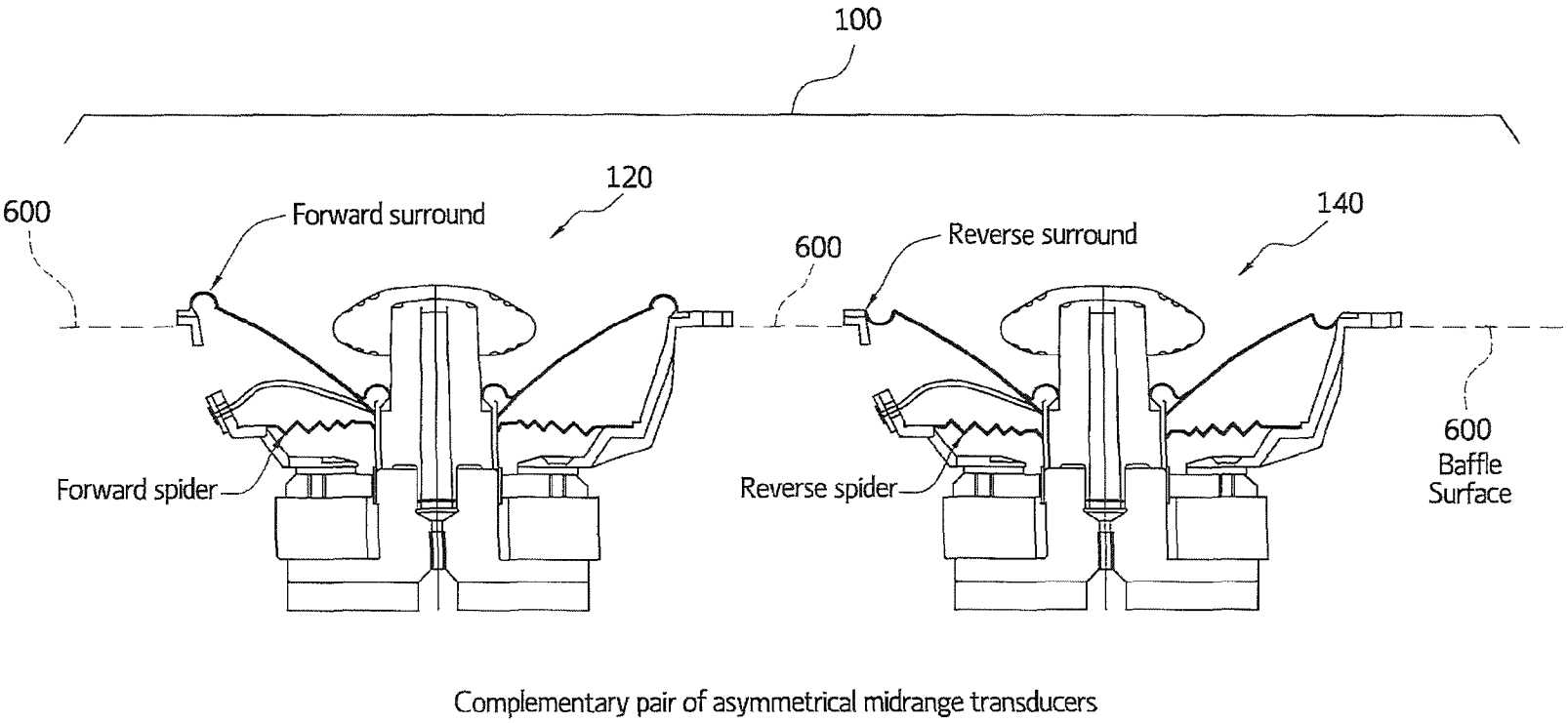
FIG. 3A is a cross-sectional view of the speaker configuration illustrating first and second asymmetrical loudspeaker drivers or transducers selected and arrayed to provide a complementary acoustical performance suitable for the loudspeaker system of the present invention.

Referring to FIGS. 2 and 3A, an improved multi-driver speaker system 100 that substantially reduces distortion and extends the useable frequency response is illustrated. In the preferred embodiment, two or more different, but complementary electrodynamic transducers or drivers 120, 140 are combined into one loudspeaker system 100. The complementary electrodynamic transducers 120, 140 are configured to be driven by the same drive signal (e.g., in parallel) and in response, act as one significantly better transducer, because each electrodynamic transducer imparts its specific benefits to the overall SPL, but the overall distortion is partially cancelled by the asymmetry of the two complementary transducers 120, 140, and hence the overall distortion is much less than a traditional combination of symmetric electrodynamic transducers (e.g., MTM system 10, as shown in FIG. 1A).

Referring to FIG. 2, the SPL level obtainable to reach 1% THD is shown for four different midrange-combinations. The curves in FIG. 2 are not SPL curves, but are the composite results of many distortion measurements to determine the observed SPL limit for 1% harmonic distortion. In this way, plotted curves 20, 22, 24 and 26 represent the observed dynamic range of the drivers at the limit of acceptable distortion. The "SPL at distortion limit" plot of FIG. 2 illustrates and summarizes both the development and benefit of the method and apparatus of the present invention (e.g., loudspeaker system 100). The series of measurements used to generate the data illustrated in FIG. 2 may be refined to reduce the effects of noise.

In FIG. 2, the darkest plot trace 20 is for a pair of identical "bass-mid" drivers, at 100 dB the usable band is 170-2500 Hz (as used in the prior art). The lightest plot trace 22 is for two identical "midranges", and at 100 dB the usable band is 205-3800 Hz (e.g., 10, as used in the prior art). The grey plot trace 24 is for the asymmetrical, complementary combination of one "bass-mid" driver combined with one "midrange" driver. At 100 dB SPL and just less than 1% distortion, the usable band is 160-3500 Hz, and the plotted data illustrates that the combination of these drivers features distortion characteristics better than either of the two types of paired identical drivers, alone. The darker grey plot trace 26 is the response from system 100 including first and second drivers specifically designed to be asymmetric and to complement each other (e.g., system 100, with drivers 120, 140). At 100 dB SPL and just less than 1% distortion, for system 100, the usable band is 85-3500 Hz+.

Referring to FIG. 2, two or more different, but complementary loudspeaker transducers (e.g., 120, 140) are mounted in close proximity on a baffle surface 600 and are combined into a single speaker system 100; where the complementary (two, four or more) transducer pairs each act as one, such that each driver imparts its benefits to the overall SPL, but the overall distortion when measured in the far field (e.g., from a listening position in a room) is much less than would be measured during playback from an identically driven traditional combination of symmetric drivers (e.g., 10). The improvement (dynamic range and reduced distortion) is achieved by combining drivers with characteristics that are asymmetric such that the characteristics complement each other in synergy. In one embodiment, as illustrated in FIG. 2, a midrange may have particularly good low frequency distortion, but the high frequency range may be limited by distortion. It is desirable to increase the high frequency range without increasing distortion. A second driver is designed such that it has extremely low distortion at high frequencies at the expense of low frequency distortion.

Figure 4A:
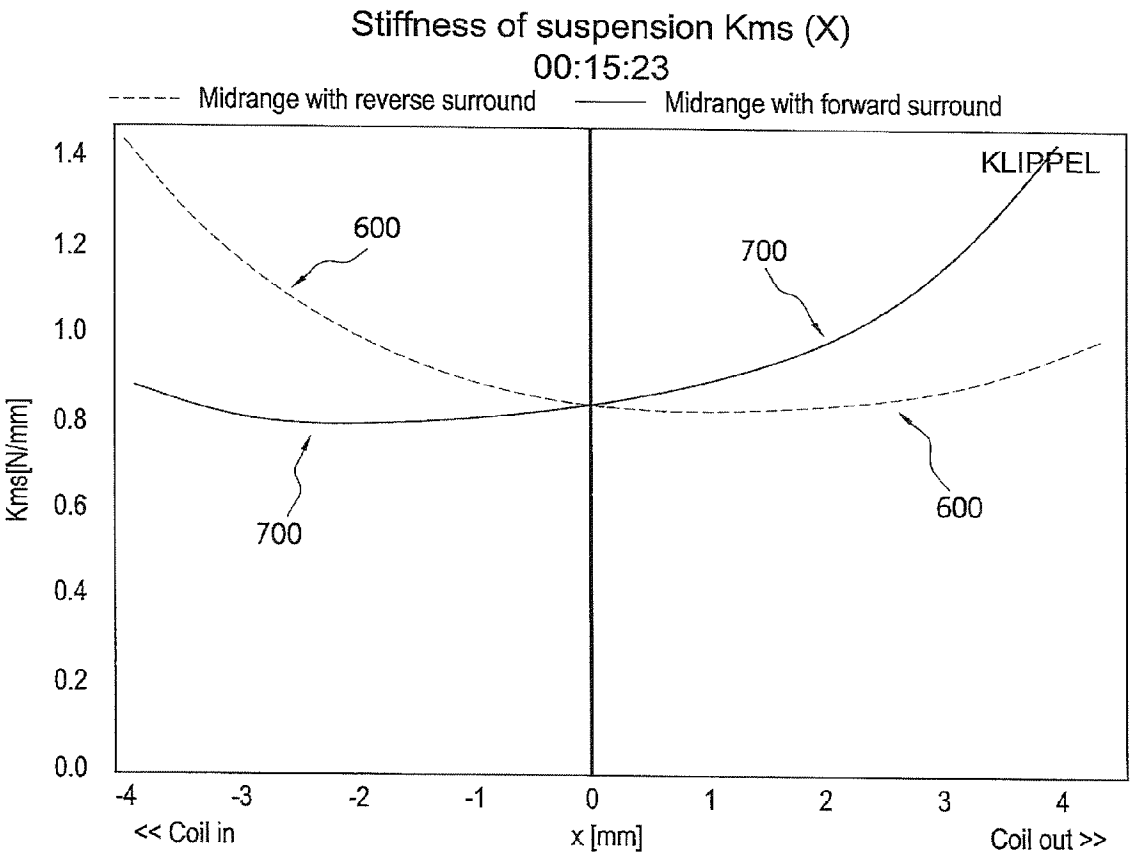
FIG. 4A is a plot of the suspension stiffness $K_{MS}$ for the complete (spider and surround) suspension systems of each driver in the loudspeaker system of FIG. 3, illustrating the suspension stiffness dissimilarity which provides the advantageous complementary acoustical performance, in accordance with the present invention.
Figure 4B:
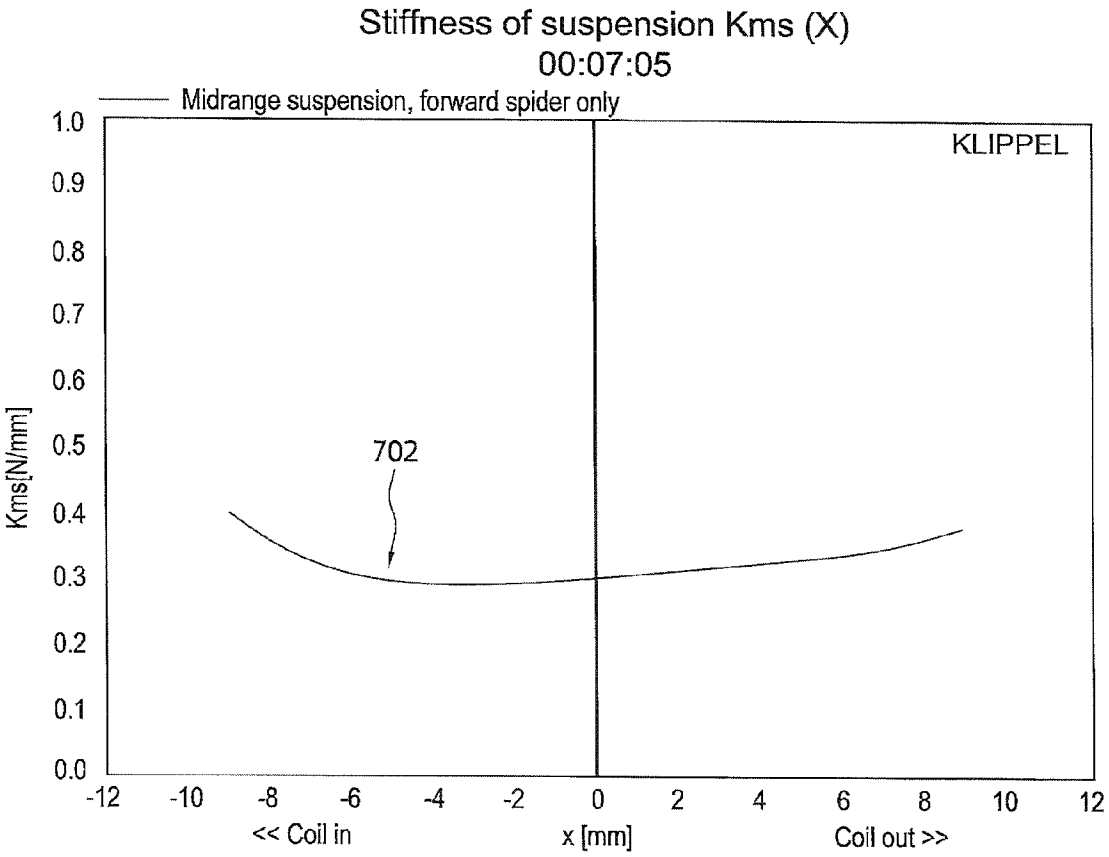
FIG. 4B is a plot of suspension stiffness $K_{MS}$ for the forward spider only for the loudspeaker driver of FIG. 3B, in accordance with the present invention.
Figure 4C:
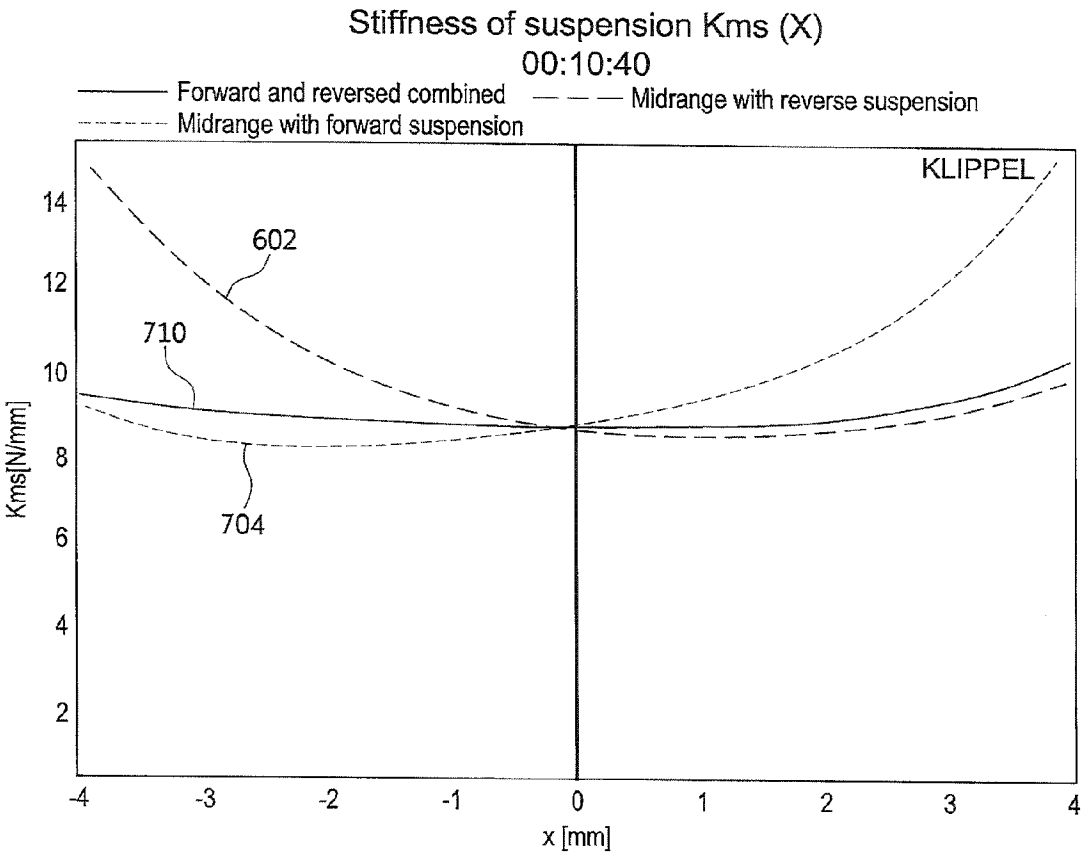
FIG. 4C is a plot of effective combined suspension stiffness $K_{MS}$ for the loudspeaker system of FIG. 3, illustrating the suspension stiffness dissimilarity which combine to generate the advantageous complementary acoustical performance or combined $K_{MS}$, in accordance with the present invention.

The applicants discovered that designing a complementary pair of drivers presented an opportunity to exploit loudspeaker component design characteristics in a novel way to achieve surprisingly good performance at an economical cost. When making a system (e.g., 100) with complementary asymmetric driver pairs, the unit price for an edge seal surround (e.g., 455, 555) does not change whether it is a large or small roll surround, the distortion remains low, but the sensitivity can increase dramatically. FIGS. 4A, 4B and 4C, illustrate suspension stiffness Kms curves for forward, reverse and combined (meaning two complementary driver) suspension configurations. In the "combined" curve 710, the inherent asymmetry from individual driver components effectively cancel out, rendering the suspension much more linear within the designed range of X for the speaker. See, for example, W. Klippel, "Diagnosis and Remedy of Nonlinearities in Electrodynamical Transducers," presented at the 109th Convention of the Audio Engineering Society, Los Angeles, Sep. 22-25, 2000, preprint 5261. And Klippel Application Notes, "Separating Spider and Surround", Application Note 2 (10/2001).

Figure 6:
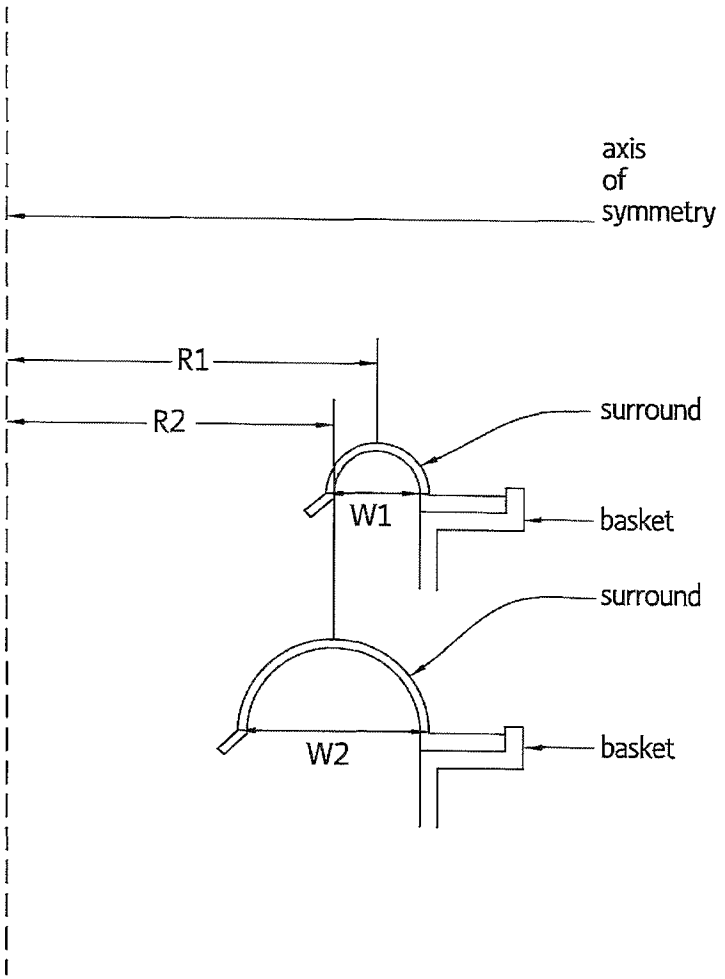
FIG. 6 is a diagram illustrating varying edge roll surround widths and their effect on excursion limits and efficiency, in accordance with the method and structure of the present invention.

One could accomplish the same result with a longer throw surround, but at a cost of >0.3 dB SPL using the equations in FIG. 6 and discussed below. Those equations describe loudspeaker suspension system parameters which describe the suspension's ability center the coil (e.g. 415 or 515) in the gap and to generate a restoring force which moves the coil back to the rest position. At low excursion amplitudes there is an almost linear relationship between displacement x and restoring force F. The restoring force is traditionally described by the product F=Kms(x)x of displacement x and stiffness Kms(x) which varies with displacement, as illustrated in FIGS. 4A-4C. The force factor BI(x) describes the coupling between mechanical and electrical sides of an electro-dynamic transducer or driver. It is the integral value of the flux density B over voice coil length I. The force factor BI(x) is a function of voice coil displacement, depending on the geometry of the coil and the magnetic field generated by the magnet.

The loudspeaker system of the present invention seeks to maximize the benefits which can be obtained by managing the stiffness KMS in the suspension components used in a complementary pair of asymmetric drivers (e.g., 120 and 140). $K_{MS}$ is the inverse of the compliance $C_{MS}(x)$. As discussed above, $K_{MS}$ is not constant (as is assumed in linear modeling) but varies with the voice coil displacement. FIG. 4A is a plot of the suspension stiffness $K_{MS}$ for the complete (spider and surround) suspension systems of each driver in the loudspeaker system 100 of FIG. 3A, illustrating the suspension stiffness dissimilarity which provides the advantageous complementary acoustical performance, in accordance with the present invention. FIG. 4B is a plot of suspension stiffness $K_{MS}$ for the forward spider 440 for loudspeaker driver 120 of FIG. 3B, in accordance with the present invention. FIG. 4C is a plot of effective combined suspension stiffness $K_{MS}$ for the loudspeaker system 100 of FIG. 3A, illustrating the suspension stiffness dissimilarity between drivers which combine to generate the advantageous complementary acoustical performance or combined $K_{MS}$, in accordance with the present invention.

The applicants determined that for an economical yet effective driver design, suspension non-linearity had to be considered carefully, and a balanced multi driver configuration was discovered to be surprisingly efficient. Efficiency or sensitivity was also a priority and if a surround with a wider roll (W2, rather than W1, as seen in FIG. 6) were used, the driver's linear excursion would increase. But, as noted in U.S. Pat. No. 8,340,340 (Bogdanov et al) FIG. 2 and the equation at Col 5 Lines 26-27, simply making the roll wider increases excursion.

$$\text{Excursion}=1.211\times W_{Roll} \quad \text{(Eq 1)}$$

This equation provides the mechanical limits of excursion, but excessive (e.g. 10%) distortion is achieved well before the mechanical limit of excursion. Since distortion due to suspension non-linearity and asymmetry needed to be reduced, one approach examined was to make the surround roll bigger (e.g., W2, which is bigger than W1, as seen in FIG. 6). This trade-off was not acceptable, however. Applicants wanted to use the smallest roll width (e.g., W1) possible in order to maximize the driver efficiency, or more correctly, "sensitivity" which is measured in dB SPU Volt. Efficiency depends in part on the effective area of the diaphragm (e.g., 410 or 510) which is defined from the diaphragm's radius ("R") as:

$$Sd(\text{effective area of diaphragm})=Pi\times R^2 \quad \text{(Eq 2)}$$

So efficiency is $$\text{Efficiency}=1.18\times[(Sd^2)/(2\times Pi*345\times R)]\times(BL/Mms)^2 \quad \text{(Eq 3)}$$

where, in Equation 3, R is the voice coil's DC resistance and $M_{MS}$ is the moving mass including the air load. Nominal sensitivity is calculated as follows:

$$\text{Nominal SPL}=10\log(\text{Efficiency}/[0.000000000002\times Pif) \quad \text{(Eq 4)}$$

and maximizing the sensitivity of the drivers (and overall system 100) of the present invention was an important system design goal.

In commercial terms, sensitivity is one of the key areas which will typically determine the sales success for a loudspeaker system. In an A-B listening test in a store or a review, the louder speaker will be usually perceived as the higher quality speaker. In the applicants' experience, sensitivity is the most important acoustic criteria for determining likely commercial success and sales appeal for a loudspeaker design. Another important consideration is perceived value which can be characterized in terms of acoustic power produced (dB or SPL) per dollar. If this speaker is being compared to another speaker in the same price range, this speaker must play as loud or louder or it will very likely be considered inferior by a significant fraction of prospective buyers. The width of the surround roll (e.g. W1) has a parasitic impact on sensitivity. Sensitivity is proportional to the square of the radiating area, which makes it proportional to the 4th power of the effective diameter of the radiating area. The effective diameter is taken to be the apex of the surround roll. For a given size of speaker basket, maximizing the diameter of the apex of the surround roll is a key to maximum sensitivity.

Since the outer edge of the surround is fixed by the driver size, the way to maximize the apex diameter is to reduce the width of the surround roll. For this reason, the edge surround roll widths on drivers 120, 140 of the present invention were deliberately reduced. The roll widths for surrounds 455 and 555 were reduced as much as possible, to where the non-linearity and asymmetry limitations were nearly exceeded or just over the line. This driver configuration works only when it is used in a system with the driver's compliment which has the edge roll surround installed in a reversed orientation so that, when both drivers are driven by identical signals (in parallel), the non-linearity and asymmetry of the two divers partially cancel, so the response, as measured in the far field is like a single, much more expensive and better driver. The comparison between the thin or narrow edge rolls (e.g. 455 and 555) of the present invention and typical or conventional edge driver rolls is summarized in Table 1, as follows:

TABLE 1

Conventional vs complementary midrange arrays.
Table of effective Diaphragm and Surround Roll width

| | W (Roll Width) Mm | R (Radius at Apex) Mm | Sd (Diaphragm effective area) cm^2 | Efficiency % | SPL (nominal) dB SPL |
|---|---|---|---|---|---|
| Conventional 5¼" midrange array | 10 | 109.5 | 94.17 | 0.51 | 89.1 |
| complementary 5¼" midrange array | 6 | 111.5 | 97.64 | 0.54 | 89.4 |
| Change | −40.00% | 2.00% | 3.70% | 6.00% | +0.3 dB |

As can be seen from the data in Table 1, the thinner or narrower edge rolls of the present invention occupy a very small radial length segment for the assembly including the diaphragm (e.g. 410) and the edge roll surround (e.g., 455) as compared to the prior art. As a result, the portion of the diaphragm and surround assembly occupied by the surround in the present invention is smaller. Based on the data in table 1, for the complementary asymmetrical midrange of the present invention (e.g., 120) the Roll Radius Ratio defined as Surround Roll Width ("W") divided by Radius R is 6 mm/111.5 mm equals 0.0538. By comparison, for the conventional midrange, the Roll Radius Ratio computed as Surround Roll Width ("W") divided by Radius R is 10 mm/109.5 mm which equals 0.0913. In accordance with the present invention, complementary asymmetric drivers with small Roll Radius Ratios (i.e., less than 0.08 and preferably in the range of 0.05 to 0.06) were discovered to provide the superior performance of loudspeaker system 100.

Figure 5:
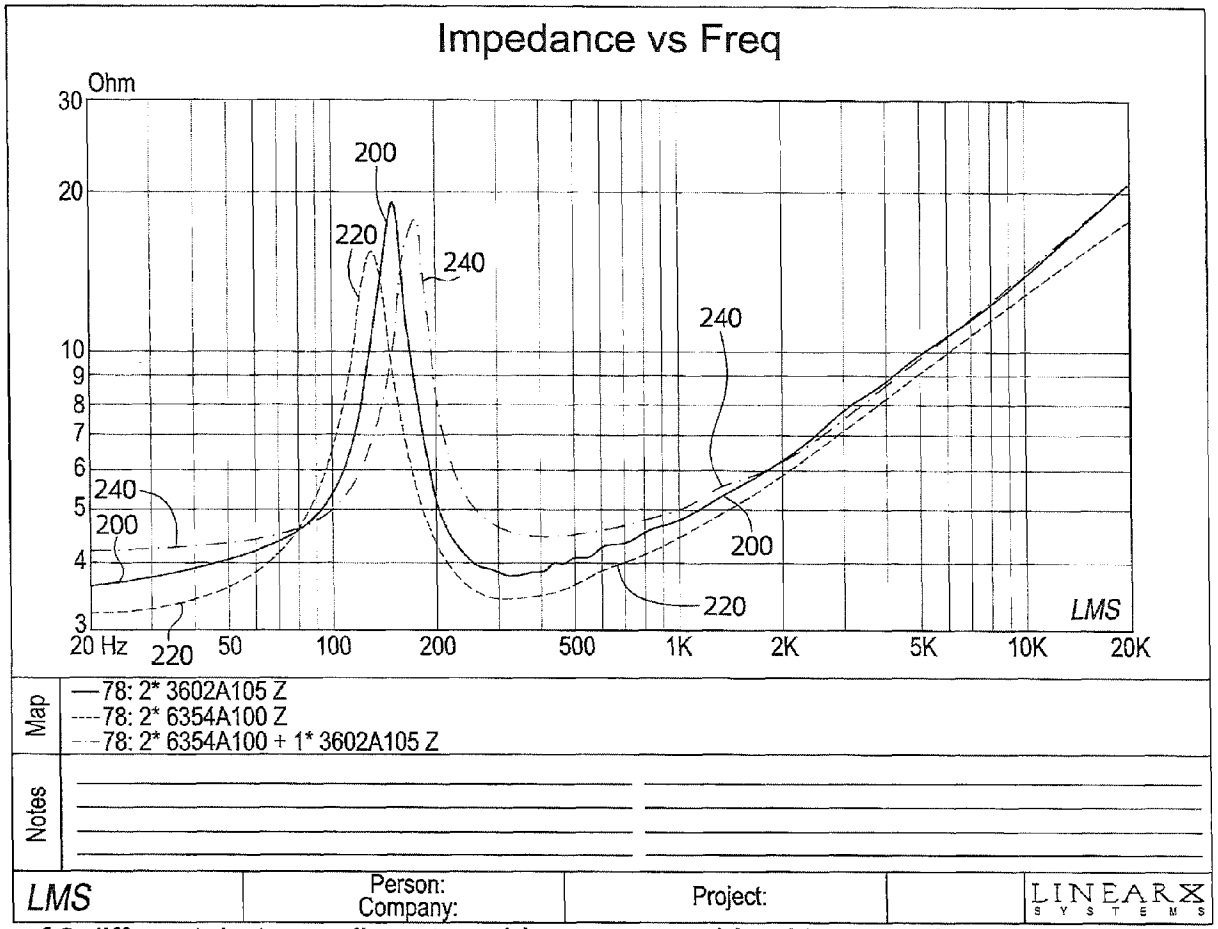
FIG. 5 is a plot of Impedance v. Frequency for exemplary drivers, illustrating impedance effects for the method and structure of the present invention.

The motor structures for system 100 were separately optimized to create surprisingly good performance using relatively economical components. Referring to FIGS. 2 and 5, in the preferred embodiment the current invention teaches the use of different motor topologies for each driver 120, 140 of the Asymmetric Transducer Configuration. As noted above, FIG. 2 illustrates the maximum SPL at 1% THD for four different driver arrays. First, plotted curve 20 illustrates impedances measured for a pair of identical mid-bass drivers having a 10 mm surround roll width (W) combined with a copper voice coil 13 mm long, resulting in a relatively heavy moving mass of 11 g and 0.46 mH of inductance. As a result, this pair of mid-bass drivers generated a 1% distortion operating window (at 95 dB) of 93 Hz to 3200 Hz and the lowest resonant frequency impedance peak (as seen in FIG. 5 in plotted curve 220). Next, curve #22 illustrates impedances measured for a pair of midrange optimized transducers having a small 4 mm surround roll width (W), combined with a Copper-Clad Aluminum voice coil 10 mm long, which provided a relatively light moving mass of 8 g and 0.38 mH of inductance. When driven with test signals, this pair of midrange optimized drivers had a 1% distortion operating or spectral window (at 95 dB) of 170 Hz to 5600 Hz, and the highest resonant frequency impedance peak (as seen in plotted curve 240 of FIG. 5).

Differing drivers were also tested, and plotted impedance curve 24 illustrates the measurement of a complementary pair of differing transducers, namely a mid-bass driver and a midrange optimized driver. The first mid-bass driver of the pair had a 10 mm surround roll width (W), combined with a Copper voice coil 13 mm long, resulting in a relatively heavy moving mass of 11 g and 0.46 mH of inductance. The second midrange optimized driver of the pair had a small 4 mm surround roll width (W), combined with a Copper-Clad Aluminum voice coil 10 mm long, resulting in a relatively light moving mass of 8 g and 0.38 mH of inductance. These complementary mid-bass and midrange optimized transducers both had forward suspension orientations (as described below), so there was no Asymmetric suspension element in the pair. As a result of synergy, this complementary pair of transducers had a 1% distortion operating window (at 95 dB) of 93 Hz to 5100 Hz, which is substantially the combined range of the driver arrays. Although individually dissimilar from each other, when combined the mid-bass and midrange optimized drivers acted as one as with a single resonant frequency impedance peak as illustrated in FIG. 5's plotted curve 200. If the complementary mid-bass and midrange optimized drivers were not acting as one, there would have been a double impedance peak.

For system 100 of the present invention, plotted curve 26 illustrates the measurement of an asymmetric complementary pair of transducers (e.g., 120 and 140) configured and assembled in accordance with the present invention. The first driver of the pair 120 has a forward suspension 440, 455 with a 6 mm surround roll width (W), combined with a Copper voice coil 415 which is 13 mm long, resulting in a relatively heavy moving mass of 11 g and 0.37 mH of inductance. The second driver of the pair 140 has a reverse suspension 540, 555 with a 6 mm surround roll width (W), combined with a Copper-Clad Aluminum voice coil 515 which is 12 mm long, resulting in a moving mass of 9.5 g and 0.24 mH of inductance. As a result of synergy, this pair of transducers has a 1% distortion operating window (at 95 dB) of 72 Hz to beyond 9000 Hz. Moreover this combination of drivers 120, 140 has the highest 1% distortion-limited SPL of 110 dB SPL in the crucial vocal range of 200 Hz to 2000 Hz.

Figure 3C:
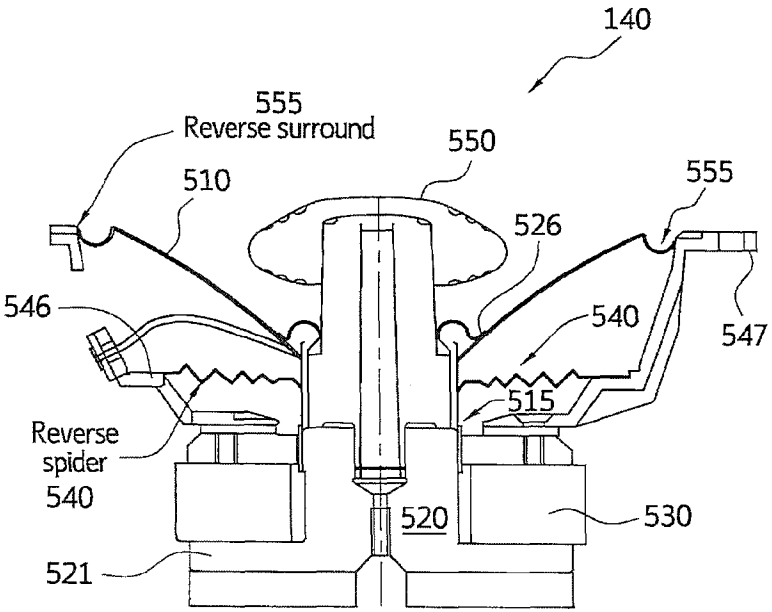
FIG. 3C is a cross-sectional view of the second asymmetrical loudspeaker driver or transducer in the array of FIG. 3A configured to compliment the acoustical performance of the transducer illustrated in FIG. 3B for the loudspeaker system of the present invention.
Figure 3B:
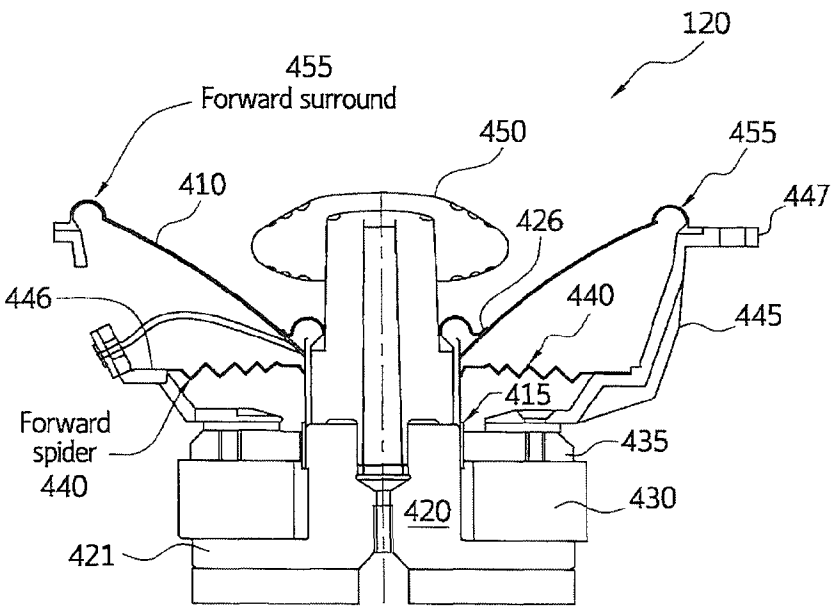
FIG. 3B is a cross-sectional view of the first asymmetrical loudspeaker driver or transducer in the array of FIG. 3A configured to compliment the acoustical performance of the transducer illustrated in FIG. 3C for the loudspeaker system of the present invention.

Turning now to FIG. 3B, the asymmetry in forward surround driver 120 is illustrated. Forward surround electrodynamic acoustic transducer 120 includes a diaphragm 410 attached at the periphery of its center opening to a voice coil assembly 415, so that movement of the voice coil assembly 415 translates into axial or linear movement of the diaphragm 410. The voice coil assembly 415 includes a former or bobbin and is disposed on and is capable of moving along a cylindrical pole piece 420. A small gap exists between the voice coil 415 and the pole piece 420. In the illustrated embodiment, the pole piece 420 is connected to or integrated with a back plate (or base) 421. Permanent magnet 430 provides the static magnetic field in which the voice coil 415 moves. The magnet 430 is a substantially annular device with a central opening of sufficient diameter to accommodate the pole piece 420. A substantially planar front plate 435 is disposed on the magnet 430, so that the magnet 430 is located between the back plate 421 and the front plate 435.

The front plate 435 is also substantially annular in shape with a central opening of sufficient diameter to accommodate the pole piece 420.

In the forward surround driver of FIG. 3B, the central opening of the front plate 435 is slightly smaller than the central opening of the magnet 430, so that the gap between the front plate 435 and the pole piece 420 is smaller than the gap between the magnet 430 and the pole piece 420. The front plate 435 has a selected thickness bounded by substantially planar front and back surfaces is made from a magnetic material (i.e., material with high magnetic permeability) such as iron, other metals, or alloys of iron and/or other metals. The pole piece 420 is also made from magnetic material, for example, the same material as the front plate 435. Thus, the flux of the static magnetic field emanated by the magnet 430 is focused (concentrated) in the annular voice coil gap defined between the front plate 435 and the pole piece 420. The voice coil 415, and particularly the portion of the voice coil 415 with the wire windings, can move along the pole piece 420 in the gap between the front plate 435 and the pole piece 420. The voice coil 415 moves out (pushes up) and in (pulls down, as the directions appear in FIG. 3B) under influence of Lorentz electromotive forces created by the interaction of the static magnetic field within the gap and the drive signal's alternating or variable current flowing through the windings of the voice coil 415. The movement of the voice coil 415 is transferred in a substantially linear manner to the diaphragm 410 through the diaphragm's neck area 426, which is attached to the voice coil assembly's cylindrical bobbin or former. Movement of the diaphragm 410 generates and radiates sound waves in response to the variations in the current driving the wire windings of the voice coil 415. Resonances of the diaphragm 410 are terminated or reflected at the neck area 426.

In addition to the flared conical shape of the diaphragm 410 illustrated in FIG. 3B, the diaphragm may assume various other shapes. In some embodiments, for example, the diaphragm 410 is an exponential flare or has a straight-sided conical shape. The diaphragm 410 may be made from various materials, as desired for specific performance characteristics and cost tradeoffs of the transducer 120. In some embodiments, for example, the diaphragm 410 is made from paper, composite materials, plastic, aluminum, and combinations of these and other suitably light, stiff materials (this list is not all-inclusive).

The forward surround driver's suspension includes a biased annular spider 440 attached at its outer periphery to an annular, planar spider support plateau 446 defined within frame 445. The inner periphery of the spider 440 is attached near the upper end of the former carrying voice coil 415, below the diaphragm 410. In this way, when at rest and not driven, the biased spider 440 provides a forward or upward facing asymmetrical elastic support for the voice coil 415, aligning and centering the voice coil 415 on the pole piece 420 in both radial and axial directions.

Referring again to FIG. 3B, illustrating upward facing driver 120, forward spider 440 has an outermost peripheral pleat which begins with a depression. The pleats in forward spider 440 consist of 4 sinusoidal peaks and 4 sinusoidal depressions. In the illustrated embodiment, the pleats in spider 440 get progressively shorter as they proceed from the outer peripheral edge to the central annular opening. Spiders with other pleat configurations can also work, but the illustrated shows that forward spider 440 and the reverse spider 540 are substantially identical components that have been installed in complementary drivers in reversed orientations, to achieve specific complementary electrodynamic performance objectives for system 100. As seen in FIG. 4B, forward spider 440 has a nonlinear asymmetric force vs distance characteristic due to asymmetrical stiffness (Coil-In and Coil-out $K_{MS}$) responses. This configuration for spider 440 provides a substantially un-equal elastic resistance to diaphragm excursion in the push (up, or coil out) excursion direction, as compared to the pull (down, or coil in) excursion direction. The spider 440 may be made from flexible material that can hold the voice coil 415 in place when the voice coil 415 is not driven by an electric current, and also allow the voice coil 415 to move up and down under influence of the electromotive force when the voice coil 415 is driven by an electric current. In some embodiments, the forward spider 440 is made from multi-layered fabric. Other suitable materials may also be used. The spider 440 may be made from any flexible material that with suitable compliance and stiffness which can hold the voice coil 415 in place when the voice coil 415 is not driven by an electric current, and also allow the voice coil 415 to move up and down under influence of the electromotive force when the voice coil 415 is driven by an electric current.

The frame 445, otherwise known as a "chassis" or "basket," is used for attaching various components of the transducer 120, including the biased spider 440. The frame 445 also supports the transducer 120 for mounting in a loudspeaker enclosure or support's baffle 600. It may be made from metal or another material with sufficient structural rigidity. In the transducer 120, the frame 445 and front plate 435 are preferably held together with bolts, while the front plate 435 and back plate 421 are preferably attached to the magnet 430 with glue, e.g., epoxy. A biased outer roll seal 455 connects the outer periphery of the diaphragm 410 to an upper lip 447 of the frame 445. The outer roll seal 455 is flexible to allow limited movement of the outer periphery of the diaphragm 410 relative to the frame 445. The dimensions of the outer seal 455 are such that it allows sufficient movement to accommodate the designed peak-to-peak excursion of the diaphragm 410 and the voice coil 415. In cross-section, the outer seal 455 may be convex or arch-like, for example, semi-circular, as is shown in FIG. 3B. In the preferred embodiment, as described above, outer seal or surround 455 has a six mm surround roll width (W). Edge Seals or roll surrounds with other configurations can also work, but the illustrated shows that forward or outer roll seal 455 and the reverse or inward roll seal 555 are substantially identical components that have been installed in complementary drivers in reversed orientations, to achieve specific complementary electrodynamic performance objectives for system 100.

The annular forward half roll surround 455 is attached at its outer periphery to an annular, planar surround support plateau 447 defined within frame 445 and, together with the spider 440, comprise the suspension. The inner periphery of forward surround 455 is attached to the upper end of the diaphragm 410. In this way, when at rest and not driven, forward surround 455 provides asymmetrical elastic support for the diaphragm 410, aligning and centering the front upward or distal edge of diaphragm 410 in both radial and axial directions. Forward surround 455 with its forward half roll provides a substantially un-equal elastic resistance to diaphragm excursion in the push (up, or coil out) excursion direction, as compared to the pull (down, or coil in) excursion direction, and this difference is reflected in plotted stiffness curves 700 and 704 as illustrated in FIGS. 4A and 4C. Forward surround 455 may be made from flexible material than can hold the diaphragm 410 in place when the voice coil 415 is not driven by an electric current, and also allow the diaphragm 410 to axially move up and down under influence of the EMF when the voice coil 415 is driven by an electric current. As noted above, copper voice coil 415 which is preferably 13 mm long, and provides a relatively heavy moving mass of 11 g and 0.37 mH of inductance.

A distally or outwardly projecting waveguide extension structure 450 is preferably attached to the upper end (as it appears in FIG. 3B) of the pole piece 420. The shape of the waveguide extension structure 450 may be such that the structure 450 clears the moving parts of the transducer 120; minimizes (reduces) diffraction of sound energy; extends forward approximately to the plane defined by the outer periphery of the diaphragm 410 when the voice coil 415 is at rest; and extends radially outward above the central radiating area of the cone so as to obscure the center portion of the diaphragm. In the driver illustrated in FIG. 3B, the waveguide extension structure 450 includes a first coaxially aligned portion of a first diameter and a second coaxially aligned, radially projecting larger diameter bulbous tip. The first diameter may be smaller than the diameter of the coaxial pole piece 420. Other shapes of the waveguide extension structure 450 also fall within the subject matter of the present invention. The waveguide extension structure 450 may be solid or hollow, and if desired may be made integral with the pole piece 420, that is, made as part of the pole piece 420. In this embodiment, the bulbous tip has a larger diameter than the pole so that it partially obscures direct sound emanating from the center radiating area of diaphragm 410. The waveguide's distal bulbous tip may be made of any appropriate acoustically damped material and with any profile or shape, solid or hollow, smooth or rough, soft or hard, continuous or discontinuous surface as required to prevent short wavelength sound from the center of the diaphragm from destructively interfering with short wavelength sound from the periphery of the diaphragm.

In the preferred embodiment, the complementary drivers 120, 140 are assembled from many identical components, but the "standard" or forward asymmetrical drivers (e.g., 120) have the selected suspension components 440, 455 installed in a forward orientation, while the "compliment" or reverse drivers (e.g. 140) have substantially identical suspension components to the forward 440, 455 installed in a reverse orientation to provide reverse suspension components 540, 555. In accordance with the method of the present invention, during assembly, for the reverse drivers, the suspension components are installed in the reverse orientation.

Turning now to FIG. 3C, the asymmetry in reverse surround driver 140 is illustrated. Reverse surround electrodynamic acoustic transducer 140 includes a diaphragm 510 attached at the periphery of its center opening to a voice coil assembly 515, so that movement of the voice coil assembly 515 translates into axial or linear movement of the diaphragm 510. The voice coil assembly 515 includes a former or bobbin and is disposed on and is capable of moving along a cylindrical pole piece 520. A small gap exists between the voice coil 515 and the pole piece 520. In the illustrated embodiment, the pole piece 520 is connected to or integrated with a back plate (or base) 521. Permanent magnet 530 provides the static magnetic field in which the voice coil 515 moves. The magnet 530 is a substantially annular device with a central opening of sufficient diameter to accommodate the pole piece 520. A substantially planar front plate 535 is disposed on the magnet 530, so that the magnet 530 is located between the back plate 521 and the front plate 535. The front plate 535 is also substantially annular in shape with a central opening of sufficient diameter to accommodate the pole piece 520.

In the reverse surround driver 140 of FIG. 3C, the central opening of the front plate 535 is slightly smaller than the central opening of the magnet 530, so that the gap between the front plate 535 and the pole piece 420 is smaller than the gap between the magnet 530 and the pole piece 520. The front plate 535 has a selected thickness bounded by substantially planar front and back surfaces is made from a magnetic material (i.e., material with high magnetic permeability) such as iron, other metals, or alloys of iron and/or other metals. The pole piece 520 is also made from magnetic material, for example, the same material as the front plate 535. Thus, the flux of the static magnetic field emanated by the magnet 530 is focused (concentrated) in the annular voice coil gap defined between the front plate 535 and the pole piece 520. The voice coil 515, and particularly the portion of the voice coil 515 with the wire windings, can move along the pole piece 520 in the gap between the front plate 535 and the pole piece 520. The voice coil 515 moves out (pushes up) and in (pulls down, as the directions appear in FIG. 3B) under influence of Lorentz electromotive forces created by the interaction of the static magnetic field within the gap and the drive signal's alternating or variable current flowing through the windings of the voice coil 515. The movement of the voice coil 515 is transferred in a substantially linear manner to the diaphragm 510 through the diaphragm's neck area 526, which is attached to the voice coil assembly's cylindrical bobbin or former. Movement of the diaphragm 510 generates and radiates sound waves in response to the variations in the current driving the wire windings of the voice coil 515. Resonances of the diaphragm 510 are terminated or reflected at the neck area 526.

In addition to the flared conical shape of the diaphragm 510 illustrated in FIG. 3C, the diaphragm may assume various other shapes. In some embodiments, for example, the diaphragm 510 is an exponential flare or has a straight-sided conical shape. The diaphragm 510 may be made from various materials, as desired for specific performance characteristics and cost tradeoffs of the transducer 140. In some embodiments, for example, the diaphragm 510 is made from paper, composite materials, plastic, aluminum, and combinations of these and other suitably light, stiff materials.

The reverse surround driver's suspension includes a biased annular spider 540 attached at its outer periphery to an annular, planar spider support plateau 546 defined within frame 545. The inner periphery of the spider 540 is attached near the upper end of the former carrying voice coil 515, below the diaphragm 510. In this way, when at rest and not driven, the biased spider 540 provides a rearward or downward facing asymmetrical elastic support for the voice coil 515, aligning and centering the voice coil 515 on the pole piece 520 in both radial and axial directions.

Referring again to FIG. 3C, illustrating upward facing driver 140, reverse spider 540 has an outermost peripheral pleat which begins with a peak (not a depression). The pleats in forward spider 540 consist of 4 sinusoidal peaks and 4 sinusoidal depressions. In the illustrated embodiment, the pleats in spider 540 get progressively shorter as they proceed from the outer peripheral edge to the central annular opening. Spiders with other pleat configurations can also work, but the illustrated embodiment shows that forward spider 440 and the reverse spider 540 are substantially identical components that have been installed in complementary drivers in reversed orientations, to achieve specific complementary electrodynamic performance objectives for system 100. As seen in FIG. 4B, forward spider 440 has a nonlinear asymmetric force vs distance characteristic due to asymmetrical stiffness (Coil-In and Coil-out $K_{MS}$) responses, and that response is reversed for reverse spider 540. This configuration for reverse spider 540 provides a substantially un-equal elastic resistance to diaphragm excursion in the push (up, or coil out) excursion direction, as compared to the pull (down, or coil in) excursion direction. The spider 540 may be made from flexible material that can hold the voice coil 515 in place when the voice coil 515 is not driven by an electric current, and also allow the voice coil 515 to move up and down under influence of the electromotive force when the voice coil 515 is driven by an electric current. In some embodiments, reverse spider 540 is made from multi-layered fabric. Other suitable materials may also be used, but the configuration and materials for reverse spider 540 and forward spider 440 should be substantially identical.

The frame 545, otherwise known as a "chassis" or "basket," is used for attaching various components of the transducer 140, including the biased spider 540. The frame 545 also supports the transducer 140 for mounting in a loudspeaker enclosure or support's baffle 600. It may be made from metal or another material with sufficient structural rigidity. In transducer 140, the frame 545 and front plate 535 are preferably held together with bolts, while the front plate 535 and back plate 521 are preferably attached to the magnet 530 with glue, e.g., epoxy. A reverse biased roll seal 555 connects the outer periphery of the diaphragm 510 to an upper lip 547 of the frame 545. The reverse biased roll seal 555 is flexible to allow limited movement of the outer periphery of the diaphragm 510 relative to the frame 545. The dimensions of the reverse biased roll seal 555 are such that it allows sufficient movement to accommodate the designed peak-to-peak excursion of the diaphragm 510 and the voice coil 515. In cross-section, the reverse biased roll seal 555 may be concave or trench-like, for example, semi-circular, as is shown in FIG. 3C. Edge Seals or roll surrounds with other configurations can also work, but the illustrated embodiments show that the reverse biased or inward roll seal 555 and forward or outer roll seal 455 are substantially identical components that have been installed in complementary drivers in reversed orientations to achieve specific complementary electrodynamic performance objectives for system 100.

The annular reverse biased roll seal 555 is attached at its outer periphery to an annular, planar surround support plateau 547 defined within frame 545 and, together with the spider 540, comprise the complementary driver's "reversed" suspension. The inner periphery of reverse biased roll seal 555 is attached to the upper end of the diaphragm 510. In this way, when at rest and not driven, forward surround 555 provides asymmetrical elastic support for the diaphragm 510, aligning and centering the front upward or distal edge of diaphragm 510 in both radial and axial directions. Forward surround 555 with its forward half roll provides a substantially un-equal elastic resistance to diaphragm excursion in the push (up, or coil out) excursion direction, as compared to the pull (down, or coil in) excursion direction, and this difference is reflected in plotted stiffness curves 600 and 602 as illustrated in FIGS. 4A and 4C. Reverse surround or roll seal 555 may be made from flexible material that can hold the diaphragm 510 in place when the voice coil 515 is not driven by an electric current, and also allow the diaphragm 510 to axially move up and down under influence of the EMF when the voice coil 515 is driven by an electric current. In some embodiments, the reverse biased roll seal or reverse surround 555 may be made from rubber. Other suitable materials may also be used. Before assembly, when considered as individual components, the configuration and materials for reverse surround 555 and forward surround 455 are preferably identical. As discussed above, in the preferred embodiment, driver 140 has a reverse suspension 540, 555 with a 6 mm surround roll width (W), combined with a Copper-Clad Aluminum voice coil 515 which is 12 mm long, resulting in a moving mass of 9.5 g and 0.24 mH of inductance.

A distally or outwardly projecting waveguide extension structure 550 is preferably attached to the upper end (as it appears in FIG. 3C) of the pole piece 520. The shape of the waveguide extension structure 550 may be such that the structure 550 clears the moving parts of the transducer 140; minimizes (reduces) diffraction of sound energy; extends forward approximately to the plane defined by the outer periphery of the diaphragm 510 when the voice coil 515 is at rest; and extends radially outward above the central radiating area of the cone so as to obscure the center portion of the diaphragm. In the driver illustrated in FIG. 3C, the waveguide extension structure 550 includes a first coaxially aligned portion of a first diameter and a second coaxially aligned, radially projecting larger diameter bulbous tip. The first diameter may be smaller than the diameter of the coaxial pole piece 520. Other shapes of the waveguide extension structure 550 also fall within the subject matter of the present invention. The waveguide extension structure 550 may be solid or hollow, and if desired may be made integral with the pole piece 520, that is, made as part of the pole piece 520. In this embodiment, the bulbous tip has a larger diameter than the pole so that it partially obscures direct sound emanating from the center radiating area of diaphragm 510. The waveguide's distal bulbous tip may be made of any appropriate acoustically damped material and with any profile or shape, solid or hollow, smooth or rough, soft or hard, continuous or discontinuous surface as required to prevent short wavelength sound from the center of the diaphragm from destructively interfering with short wavelength sound from the periphery of the diaphragm.

While the distortion mechanisms of an electro-magnetic transducer may be determined, practical design constraints force compromises. If the aforementioned 2nd driver's distortion mechanisms are such that they are exactly asymmetric to the first driver, and if the parameters of the two drivers are otherwise similar, then the current invention teaches that the drivers can be combined in such a way that the SPL benefits to the fullest, while the distortion in any particular frequency range is at least partially cancelled by the asymmetry.

One way that asymmetry is achieved is by finding the components of the transducers that are inherently asymmetric and reversing them on the complementary transducer. In FIG. 2, for example, the surround or edge typically is an arch shaped piece of elastomer that contributes greatly to the asymmetry of the transducer suspension. There are constraints on the design of the surround that cause it to be non-linear and asymmetric. The stiffness of the forward and reverse suspension is illustrated in FIG. 3. By combining a transducer 120 with a forward facing surround with a second transducer 140 with a reverse facing surround, the performance asymmetries will partially cancel each other out, resulting in the system behaving more linear (lower distortion) than a pair of identical matched transducers.

The system of the present invention (e.g., 100) differs from the prior art in several ways. In Prior Art loudspeaker systems, crossover networks are often used to divide the drive signal spectrum and select which frequencies of audio are sent to each driver (e.g., woofers, midrange drivers, tweeters). The current invention differs in that the drivers are operated in parallel with no crossover network dividing the frequencies between them. That is, each transducer (e.g., 120, 140) sees the same signal as its complementary transducer. Moreover, the 2 (or more) drivers behave as one driver and can be characterized as a single driver of higher performance than either on their own.

Second, traditional loudspeaker enclosure acoustic design required that different drivers be acoustically isolated in separate chambers to prevent negative interactions. This invention teaches to combine different drivers in a single chamber so that they interact as one. In a third example of differences with prior art, transducers may be combined in a single chamber if the drivers have the same characteristics, but then the distortion characteristics and range will be that of a single transducer. In a fourth example, the drivers are combined in a shared chamber with a network (not frequency dividing) or other methods are used to prevent said negative interactions. The so-called 2.5 way crossover is an example of such a network. In this case the drivers each contribute SPL, but some drivers have extra crossover components to limit their SPL contribution to a subset of the overall range. In this manner range may be extended and SPL increased, but there is no inherent distortion reduction.

In the preferred embodiment, the complementary drivers 120, 140 are assembled mostly from substantially identical components, but the "standard" or forward asymmetrical drivers (e.g., 120) have the selected suspension components 440, 455 installed in a forward orientation, while the "compliment" or reverse drivers (e.g. 140) have substantially identical suspension components to the forward 440, 455 installed in a reverse orientation to provide reverse suspension components 540, 555. In accordance with the method of the present invention, during assembly, for the reverse drivers, the suspension components are installed in the reverse orientation.

Turning again to FIG. 5, the plot of impedance v. Frequency provided for system 100 with complementary asymmetric drivers (e.g. 120, 140) in curve 26 illustrates that each of two different, but complementary drivers are combined in an enclosure (not shown) to act as one driver (having performance illustrated in solid curve 200). Drivers that are quite dissimilar will have two (2) distinct impedance peaks and the advantageous performance of the system and method of the present invention is not observed.

An electrical drive signal current flow in the voice coils drives the diaphragms and can produce a considerable amount of heat, so loudspeaker system 100 may need provision to cool the drivers. In an exemplary form of the invention, the drivers (e.g., 120 & 140) may be mounted within a heat conducting baffle (e.g. 600) in loudspeaker enclosure (not shown) which provides a solid, vibration-free environment, and an optional gasket (not shown) which secures the driver in a panel aperture and also serves to seal the enclosure for improved sound quality.

The enclosure (not shown) may incorporate one or more complementary pairs of loudspeakers or systems 100 along with other drivers (e.g., tweeters, woofers) constructed in the manner described above, to provide a multi-driver array loudspeaker system having a wide frequency response. In one embodiment, the enclosure may be elongated in shape, carrying, for example, two woofer loudspeakers and two mid-range speakers mounted in a row with one or more conventional tweeters, and with the face of the enclosure covered by a suitable screen, or grille (not shown).

Generally speaking, the present invention can be characterized as providing an improved loudspeaker system (e.g., 100), comprising at least a first driver having a first set of acoustic (e.g., Thiel/Small) parameters 120 and a second driver having a second set of acoustic parameters 140 which are different than, but complementary to the acoustic parameters of the first driver's parameters, wherein the first driver and the second driver are configured upon a surface (e.g., baffle 600) or within an enclosure to project sound toward the listener's position (not shown) which combines in front of the drivers (in the far field) so that the complementary drivers (e.g., 120, 140) when driven by a drive signal, act as one driver (as shown in performance curves 26, 704). Loudspeaker system 100 optionally includes an asymmetrical array including dissimilar drivers, and may comprise a first midrange driver and a second mid-bass driver configured in an array and driven with the same drive signal. The improved loudspeaker system of the present invention may include a first midrange driver (e.g., 120) with a forward surround of a first selected stiffness characteristic (e.g., 704 as shown in FIGS. 3B and 4C) and a second midrange driver (e.g., 140) having a reverse surround of a second selected stiffness characteristic (e.g., 602 as shown in FIGS. 3C and 4C).

Figure 1B:
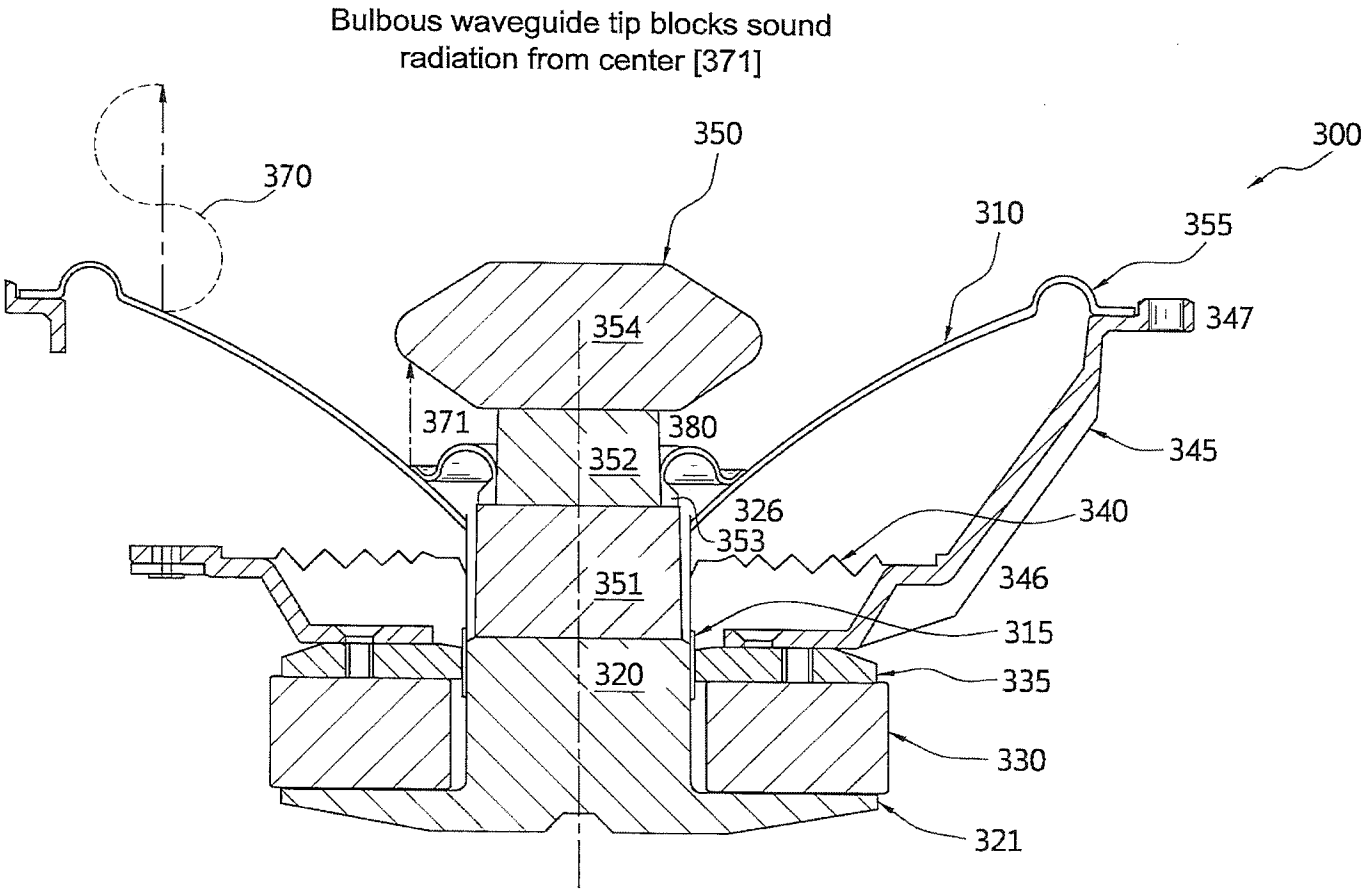
FIGS. 1B and 1C illustrate applicant's own prior loudspeaker driver configuration, as described in applicant's commonly owned U.S. patent application Ser. No. 13/162,296, in accordance with the prior art.
Figure 1C:
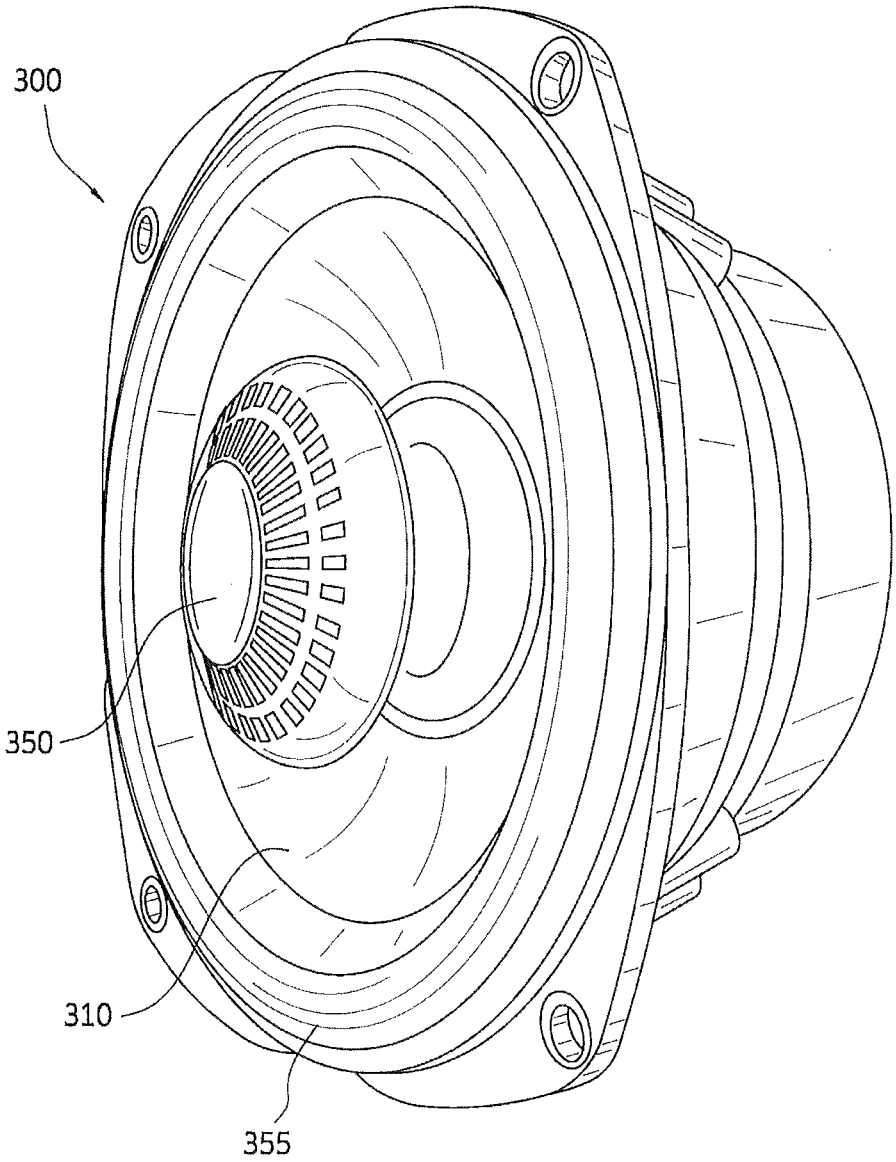

The improved loudspeaker system of the present invention (e.g., 100) may incorporate any of the design features discussed above, so, for example, an improved novel MTM array similar to that illustrated in FIG. 1 may be configured with a tweeter surrounded (e.g., above and below) by complementary asymmetric midrange drivers 120 and 140 to produce a higher performance M-T-$M_{Compliment}$ system. Alternatively, a wider spectrum system may be configured with a tweeter surrounded (e.g., above and below) by complementary asymmetric Mid-Bass drivers to produce a higher performance MidBass-Tweeter-$MidBass_{compliment}$ system.

Many additional modifications are intended in the foregoing disclosure, and it will be appreciated by those of ordinary skill in the art that in some instances some features of the invention will be employed in the absence of a corresponding use of other features. The illustrative examples therefore do not define the metes and bounds of the invention or the legal protection afforded the invention, which is defined by the appended claims.

What is claimed is:

1. An improved loudspeaker system, comprising:

at least a first driver having a first set of acoustic parameters and a second complementary driver having a second set of acoustic parameters which are different than, but complementary to the acoustic parameters of the first driver's parameters;

said first driver comprising a first diaphragm and a first suspension system having a first selected $C_{MS}$ compliance and a first selected $K_{MS}$ stiffness when affixed to said diaphragm in a first forward orientation;

said second driver comprising a second diaphragm and a second suspension system having a second selected $C_{MS}$ compliance and a second selected $K_{MS}$ stiffness when affixed to said diaphragm in a second reverse orientation;

wherein said first driver's first selected $C_{MS}$ compliance and first selected $K_{MS}$ stiffness during an inward excursion are substantiall equal to said second driver's second selected $C_{MS}$ compliance and second selected $K_{MS}$ stiffness during an outward excursion, thereby providing acoustic parameters for said first driver which are complimentary to said second driver; and wherein the first driver and the second driver are configured upon a surface or within an enclosure to combine and act as one driver when driven with the same drive signal, thereby providing first and second complementary asymmetrical drivers.

2. The improved loudspeaker system of claim 1, wherein the loudspeaker system includes an asymmetrical array including dissimilar drivers, wherein said first driver comprises a first midrange or midbass driver and wherein said second driver comprises a second mid-bass or midrange driver, said first and second drivers being configured in an array and driven with the same drive signal.

3. The improved loudspeaker system of claim 2, wherein the first driver has a forward surround of a first selected KMS stiffness and the second driver has a reverse surround of a second selected KMS stiffness.

4. The improved loudspeaker system of claim 2, wherein the first driver has a forward surround of a first selected $K_{MS}$ stiffness which provides a first frequency response with a first impedance peak at a first impedance peak frequency and the second driver has a reverse surround of a second selected $K_{MS}$ stiffness which provides a mid-bass driver having a second frequency response with a second impedance peak at a second impedance peak frequency which is lower than said first driver's first impedance peak frequency.

5. The improved loudspeaker system of claim 1, further comprising a substantially linear array of Drivers and having a tweeter surrounded by said first and second complementary asymmetric drivers configured as midrange drivers to provide a higher performance M-T-$M_{Compliment}$ loudspeaker system.

6. The improved loudspeaker system of claim 1, further comprising a substantially linear array of Drivers and having a tweeter surrounded by said first and second complementary asymmetric drivers configured as Mid-Bass drivers to provide a higher performance MidBass-Tweeter-Mid-$Bass_{Compliment}$ system.

7. The improved loudspeaker system of claim 1, wherein said first and second complementary asymmetrical drivers have a Roll Radius Ratio defined as Surround Roll Width ("W") divided by Radius R which is less than 0.08.

8. The improved loudspeaker system of claim 7, wherein said first and second complementary asymmetrical drivers have a Roll Radius Ratio which is within the range of 0.05 to 0.06.

9. The improved loudspeaker system of claim 8, wherein said first and second complementary asymmetrical drivers have a Roll Radius Ratio defined as Surround Roll Width ("W") divided by Radius R is 6 mm/111.5 mm equals 0.0538.

10. The improved loudspeaker system of claim 9, wherein said first and second complementary asymmetrical drivers are 5¼ inch midrange drivers with a Surround Roll Width ("W") of six millimeters.

11. The improved loudspeaker system of claim 7, further comprising a substantially linear array of Drivers and having a tweeter surrounded by said first and second complementary asymmetric drivers configured as midrange drivers to provide a higher efficiency M-T-$M_{Compliment}$ loudspeaker system.

12. The improved loudspeaker system of claim 1, wherein the first and second complementary asymmetrical drivers are assembled from many substantially identical loudspeaker driver components, but the first asymmetrical driver has at least a first selected suspension component installed in a forward orientation, while the second driver has a first substantially identical suspension component installed in a reverse orientation to provide an asymmetrically reversed suspension component.

13. The improved loudspeaker system of claim 12, wherein the first asymmetrical driver's first selected suspension component installed in the forward orientation comprises either a spider or an edge seal or roll surround.

14. The improved loudspeaker system of claim 13, wherein the first asymmetrical driver's first selected suspension component installed in the forward orientation is the spider and the first asymmetrical driver has a second selected suspension component which can be installed in a forward orientation comprising an edge roll surround.

15. The improved loudspeaker system of claim 13, wherein the first asymmetrical driver's first selected suspension component installed in the forward orientation is the spider and the first asymmetrical driver has a second selected suspension component which can be installed in a forward orientation comprising an edge roll surround installed in a forward orientation.

16. The improved loudspeaker system of claim 13, wherein the first asymmetrical driver's first selected suspension component installed in the forward orientation is the spider and the first asymmetrical driver has a second selected suspension component which can be installed in a forward orientation comprising an edge roll surround installed in a reverse orientation.

17. The improved loudspeaker system of claim 12, wherein the second asymmetrical driver's first selected suspension component installed in the reverse orientation comprises either a spider or an edge seal or roll surround.

18. The improved loudspeaker system of claim 17, wherein the second asymmetrical driver's first selected suspension component installed in the forward orientation is the spider and the second asymmetrical driver has a second selected suspension component which can be installed in a reverse orientation comprising an edge roll surround.

19. The improved loudspeaker system of claim 1, wherein said first and second complementary asymmetrical drivers are configured and assembled with said first driver of the pair having a forward suspension with a first selected surround roll width (W), combined with a voice coil having a selected length, resulting in a selected first moving mass of and a selected first inductance;

wherein said second driver has a reverse suspension of said first surround roll width (W), combined with a second voice coil which of a second length, resulting in a second moving mass and a selected second inductance;

wherein, as a result of synergy, this pair of drivers generates an acoustical output at a selected low distortion operating window (at 95 dB) over a selected frequency range.

20. The improved loudspeaker system of claim 19, wherein said first and second complementary asymmetrical drivers are configured and assembled with said first driver of the pair having a forward suspension with a first selected surround roll width (W) of 6 mm, combined with a voice coil having a selected length of 13 mm, resulting in a selected first moving mass of 9.5 g and a selected first inductance of 0.37 mH;

wherein said second driver has a reverse suspension having said first surround roll width (W) of 6 mm, combined with a second voice coil which of a second length of 13 mm, resulting in a second moving mass of 9.5 g and a selected second inductance of 0.24 mH;

wherein said first and second complementary asymmetrical drivers, when driven by a selected audio signal, together generate an acoustical output at a selected low distortion of no more than 1% over an operating window (at 95 dB) of 72 Hz to beyond 9000 Hz; and wherein said first and second complementary asymmetrical drivers generate a high 1 % distortion-limited SPL of 110 dB SPL in the crucial vocal range of 200 Hz to 2000 Hz.

* * * * *